US010221587B1

(12) United States Patent
Bergman et al.

(10) Patent No.: US 10,221,587 B1
(45) Date of Patent: Mar. 5, 2019

(54) SYSTEM AND METHOD FOR PREVENTING MOVEMENT OF A DOOR LEVER

(71) Applicants: Judah Bergman, Lakewood, NJ (US); Yishak R. Sultan, Lakewood, NJ (US)

(72) Inventors: Judah Bergman, Lakewood, NJ (US); Yishak R. Sultan, Lakewood, NJ (US)

( * ) Notice: Subject to any disclaimer, the term of this patent is extended or adjusted under 35 U.S.C. 154(b) by 0 days.

(21) Appl. No.: 16/104,874

(22) Filed: Aug. 17, 2018

(51) Int. Cl.
*E05B 13/00* (2006.01)
*E05B 65/00* (2006.01)

(52) U.S. Cl.
CPC ..... *E05B 13/002* (2013.01); *E05B 65/0014* (2013.01)

(58) Field of Classification Search
CPC ..... Y10T 70/7915; Y10T 70/5774; Y10T 292/34; Y10T 292/1028; Y10T 292/397; Y10T 292/1089; Y10T 292/228; Y10T 292/0908; Y10T 292/37; Y10T 292/57; Y10T 70/411; Y10T 70/8649; E05B 13/04; E05B 13/002; E05B 13/001; E05B 65/0014; E05B 13/00; E05B 17/2007; Y10S 292/02; Y10S 70/58; Y10S 292/65
See application file for complete search history.

(56) References Cited

U.S. PATENT DOCUMENTS 3,643,478 A * 2/1972 McPeake ..... E05B 13/002 292/259 R
3,861,726 A * 1/1975 McLennan ..... E05C 3/048 292/205
4,322,100 A * 3/1982 McLennan ..... E05C 3/048 292/67
4,947,663 A * 8/1990 Yeager ..... E05B 13/002 70/416
5,689,984 A * 11/1997 Diculescu ..... E05B 13/002 70/214
6,301,941 B1 * 10/2001 Nicholsfigueiredo .. E05B 13/04 292/150
6,929,292 B1 * 8/2005 Galindo ..... E05B 65/0014 292/1
7,048,315 B2 * 5/2006 Wong ..... E05B 13/002 292/297
7,377,135 B2 * 5/2008 Copus ..... E05B 13/002 292/258
9,206,631 B2 * 12/2015 Lee ..... E05C 19/188
9,371,673 B2 * 6/2016 Nichol ..... E05B 13/002
2009/0235704 A1 * 9/2009 Quach ..... E05B 13/002 70/416
2009/0302617 A1 * 12/2009 Schmid ..... E05B 65/10 292/92
2010/0031715 A1 * 2/2010 Bundy ..... E05B 13/00 70/129

(Continued)

*Primary Examiner* — Mark A Williams
(74) *Attorney, Agent, or Firm* — David J. Smith

(57) ABSTRACT

A device preventing movement of a lever in an upward and downward direction is disclosed. The device has a first projection and a second projection that are moveable radially to a first position that prevents movement of the lever, and to a second position that permits movement of the lever. The first projection and the second projection may be moved independently by engaging respective buttons on the first projection and the second projection. The device has many uses, included as a safety device to prevent children or others from moving a door lever to open a door.

20 Claims, 4 Drawing Sheets

(56) References Cited

U.S. PATENT DOCUMENTS

| | | | | |
|---|---|---|---|---|
| 2010/0236299 | A1* | 9/2010 | Price | E05B 13/001 70/91 |
| 2012/0222459 | A1* | 9/2012 | Glazar | E05B 13/04 70/91 |
| 2012/0248793 | A1* | 10/2012 | Fiedler | A44B 11/258 292/163 |
| 2014/0007632 | A1* | 1/2014 | Daniels | E05B 17/2007 70/447 |
| 2014/0175814 | A1* | 6/2014 | Holsopple | E05B 13/04 292/348 |
| 2014/0300114 | A1* | 10/2014 | Atkinson, Jr. | E05B 63/18 292/259 R |

* cited by examiner

SYSTEM AND METHOD FOR PREVENTING MOVEMENT OF A DOOR LEVER

BACKGROUND OF DISCLOSURE

There are various situations in which it may be beneficial or useful to prevent access to a cabinet or room. For example, it is common to use safety covers for door knobs to prevent children, people suffering from mental or other disorders, and others from accessing these areas. Typically, these door knob covers do not prevent access but merely make it difficult for these individuals to access by providing a hinderance to turning the door knob.

However, some homes utilize door levers that move upward or downward to open a cabinet or door, rather than being rotated as is the case for door knobs. As a result, a cover for the door lever is not practical and would not serve the function of preventing access. While sometimes these door levers have locks, the locks are frequently automatically unlocked when the door handle is rotated from the interior side of the door (i.e. inside of the building or room). Thus, the only way to prevent unlocking and opening of the door by children or others is to prevent movement of the door lever.

One known device for providing a hinderance to movement of the door lever is shown in FIG. 1A. The device is manufactured by Safety 1st. The device 1 has a backing 10 attached to a door. A first lever 12 is positioned above a door lever 20 and extends perpendicular from the back portion 10. The first lever 12 is not moveable and prevents upward movement of the door lever 20. As a result, the device 1 is required to be removed to move the door lever 20 in an upward direction. A second lever 14 is positioned a distance below the first lever 12. The second lever 14 is moveable from a downward position, shown in FIG. 1B to the upward position shown in FIG. 1A. On each side of the second lever 14 are buttons 18*a* (only one of two buttons shown) that are pressed to permit movement of the second lever 14 from the downward position to the upward, locked position.

The device 1 has several deficiencies. First, the first lever 12 is not moveable and cannot be moved to permit upward movement of the door lever 20. Second, even if the device 1 is in the open position such that the door lever 20 can be moved, the first lever 12 is positioned right above the door lever 20 making it difficult to grasp and move the door lever 20. Third, the second lever 14 moves upward and downward and remains in the path of movement for the door lever 20. Accordingly, even in the open position, the second lever 14 is a hinderance to grasping and moving the door lever 20 downward to open the door. Therefore, the device 1 has numerous deficiencies that prevent it from being installed to prevent access while permitting access when required.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

In one or more embodiments, a device is disclosed. The device can have a base portion with a first side and a second side opposite the first side. The second side of the base portion is securable to a surface of a door. The base portion can have a width defined between a first end and a second end. A first projection extends from the base portion, the first projection is moveable in a radial direction toward the first end and the second end. A second projection extends from the base portion and is positioned a distance from the first projection and moveable radially toward the first end and the second end.

In one or more embodiments, a method is disclosed that can comprise securing a back portion of a device to a surface of a door such that a first projection of the device is above a lever of a door and a second projection of the device is positioned below the door lever. The back portion of the device has a width defined between a first end and a second end. The method also comprises moving one of a first projection and second projection in a radial direction to a first position such that the first projection and the second projection extend substantially perpendicular to the width of the back portion to prevent the door lever from moving upward or downward.

In one or more embodiments, a method is disclosed that comprises securing a device to a surface behind a door lever such that a first projection and a second projection of the device are positioned above and below the door lever. The method may further comprise pressing a first button on the first projection to radially move the first projection to a first position extending perpendicular with respect to the door lever to prevent movement of the door lever in an upward direction. Additionally, the method may comprise pressing a second button on the second projection to radially move the second projections to a first position extending perpendicular with respect to the door lever to prevent movement of the door lever in a downward direction.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION OF THE DISCLOSURE

Figure 1A:
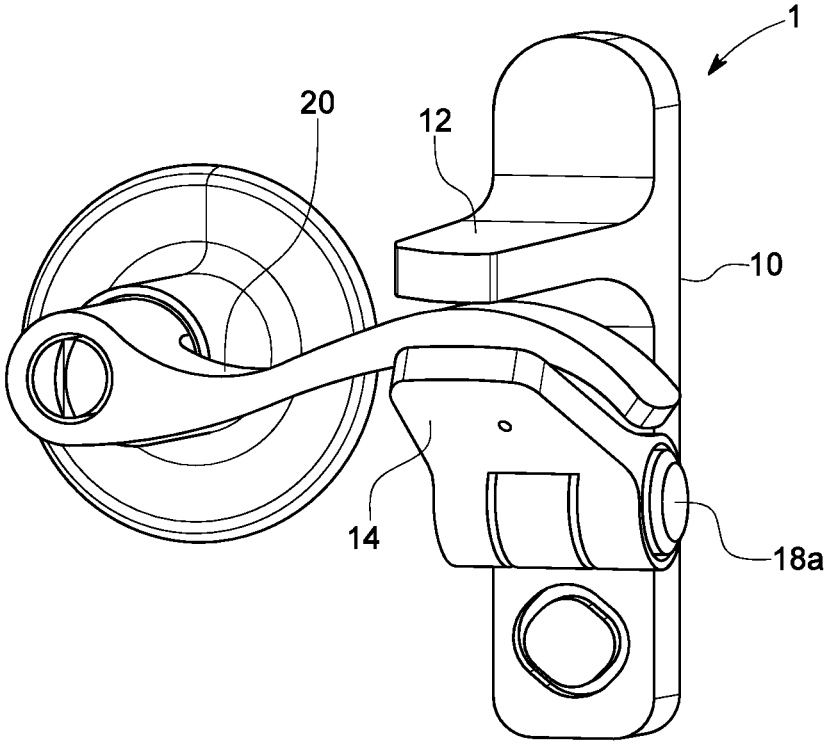
FIG. 1A (PRIOR ART)
FIG. 1A illustrates a prior art door lever device in a locked position.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

Figure 2:
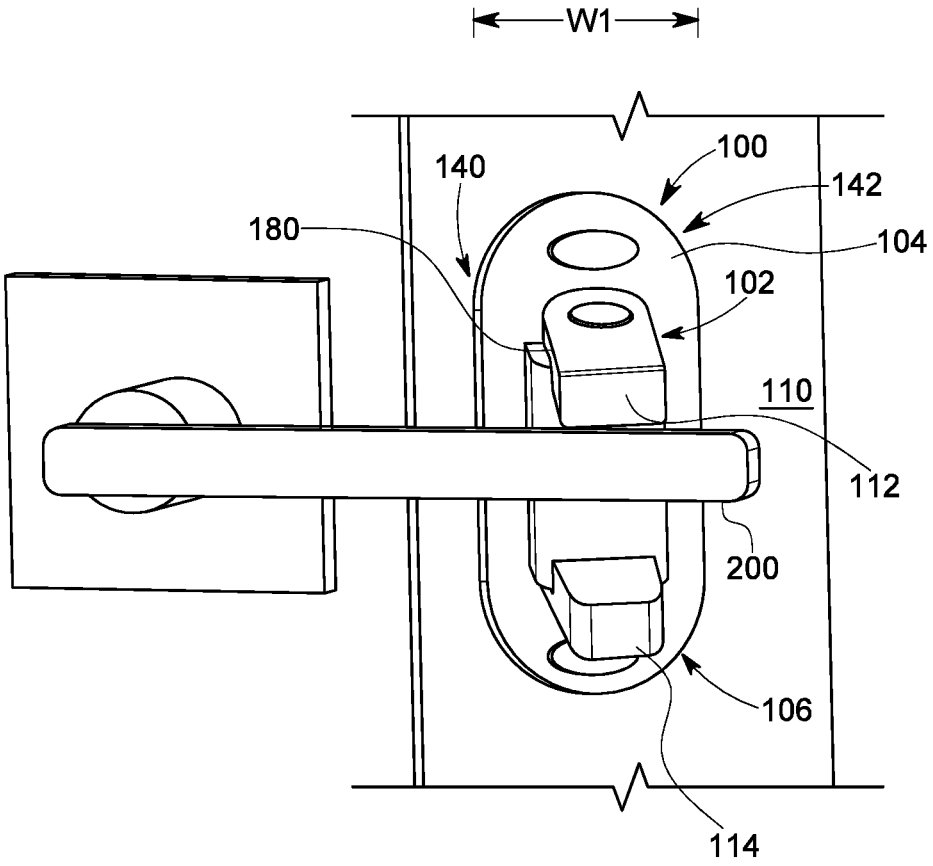
FIG. 2 illustrates a lever hindering device in a locked position in an embodiment of the present disclosure.
Figure 3:
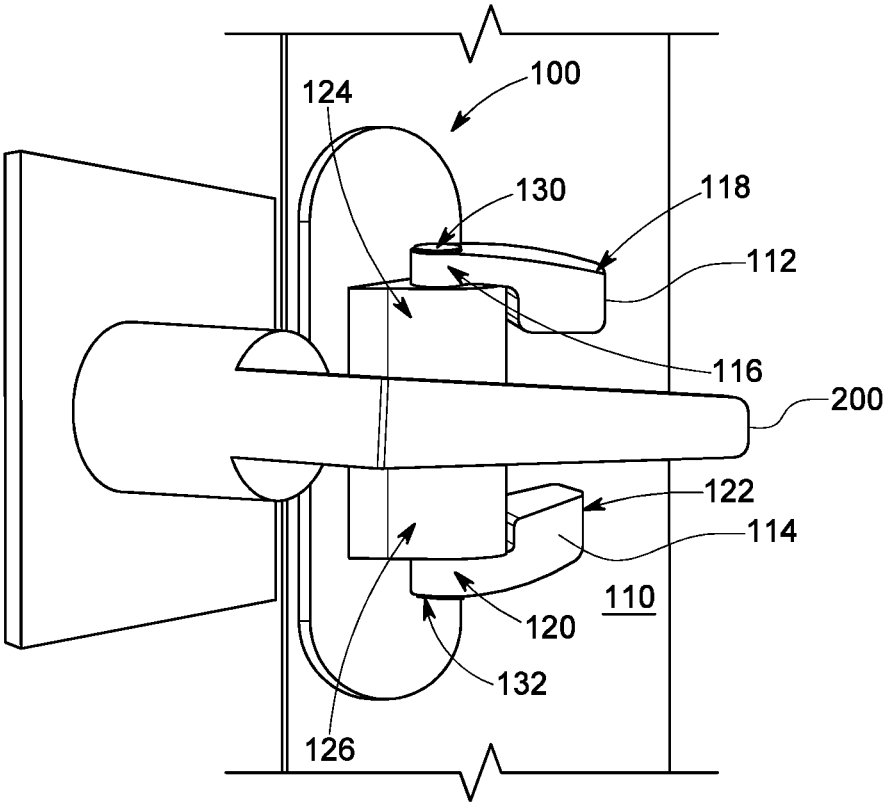
FIG. 3 illustrates a lever hindering device in an unlocked or open position in an embodiment of the present disclosure.

Turning to FIGS. 2 and 3, examples of embodiments of the device 100 are shown. A person having ordinary skill in the art will appreciate that various configurations, additional components may be provided or eliminated, and other modifications may be provided within the spirit of the disclosed invention. FIGS. 2 and 3 are not used herein to limit the invention, and the claims provided herein set forth the meets and bounds of the claimed invention.

As shown in FIGS. 2 and 3, the device 100 is generally shown. A base portion 102 having a first side 104 and a second side 106 opposite the first side 104. In an embodiment, the base portion 102 may be generally flat and elongated. The second side 106 can be secured to a surface 110, such as a surface of a door, cabinet or other device having a lever 200, as shown in FIG. 2. The second side 106 may be secured by an adhesive, such as an adhesive with a removable backing layer, Velcro, fasteners or other mechanisms that will be appreciated by those having ordinary skill in the art. In some embodiments, the second side 106 of the base portion 102 can be removably attached without damaging the surface 110. Advantageously, the base portion 102 can then be secured to the surface 110 temporarily if it is desirable to impede and/or prevent movement of the lever 200 and, later be removed if it is no longer needed. The base portion 102 can have a width, W1, defined between a first end 40 and a second end 42.

A first projection 112 and a second projection 114 extend from the base portion 102. The first projection 112 and the second projection 114 are radially supported and secured to the base portion 102. A length of the first projection 112 can be defined between a first end 116 and a second end 118. A length of the second projection 114 can be defined between a first end 120 and a second end 122. In an embodiment, the first projection 112 and the second projection 114 can have a substantial similar or the same length. The length of the projections 112, 114 may be greater than a distance D1 of the lever 200 from the surface 110. In an embodiment, the minimum length of the projections 112, 114 can be equal to a distance of the lever 200 from a surface on which it is attached and/or secured. The length of the projections 112, 114 can extend the distance of the lever 200 from the surface plus a distance to compensate for a width of the lever 200 and/or to ensure the lever 200 can prevent movement of the lever 200. The projections 112, 114 may have a tapered edge adjacent the second ends 118, 122 to prevent or reduce possibility of harming a user or others that may contact the projections 112, 114.

Hinges 124, 126 may permit movement, for example, radial movement of the first projection 112 and the second projection 114 with respect to the base portion 102. The projections 112, 114 can move radially about the hinges 124, 126. The projections 112, 114 move radially along a path between the first end 40 in a radial direction to the second end 42 of the base portion 102. The path of movement of the projections 112, 114 may move along an arc-like path from the first end 40 to the second end 42 and in a radial direction with respect to the base portion 102. The projections 112, 114 may move to a first position that is perpendicular to the width of the base portion 102.

In the first position, the second ends 118, 122 of the projections 112, 114 can be at a maximum distance from the surface 110. At the first portion, the first projection 112 can prevent the lever 200 from moving in an upward direction. The length of the first projection 112 at the first position extends in a direction that is substantially perpendicular to a direction of the width of the base portion 102. The lever 200 may contact the first projection 112 at the first position, and the lever 200 can be prevented from further upward movement. For example, the lever 200 may abut the first projection 112 in the first position prior to the lever 200 opening the door, cabinet or other surface the lever 200 is attached thereto.

At the first position, the second projection 114 can prevent the lever 200 from moving in a downward direction. The length of the second projection 114 at the second position can extend in a direction substantially perpendicular to the width of the base portion 102. The lever 200 may contact the second projection 114 at the first position, and the lever 200 can be prevented from further downward movement. For example, the lever 200 may abut the second projection 114 in the first position prior to the lever 200 opening the door, cabinet or other surface the lever 200 is secured thereto. The lever 200, as an example, may be connected to a door whereby movement of the lever 200 in the upward or downward direction may open the door. Preventing movement of the lever 200 in the upward or downward direction can prevent the door from being opened for any number of reasons that will be apparent to those having ordinary skill in the art, including preventing access to children, elderly or others. In an embodiment, the device 100 having the projections 112, 114 can be used to prevent children to access a cabinet or room for safety purposes.

The projections 112, 114 can move independently from the first position along the arc-like path in a radial direction with respect to the base portion 102. For example, one of the projections 112, 114 can move radially without movement of the other one of the projections 112, 114.

The projections 112, 114 can move to a second position that may be substantially parallel to the width of the projections 112, 114, such as shown in FIG. 3. At the second position, the first projection 112 may permit movement of the lever 200 in the upward direction. Advantageously, the second end 118 of the first projection 112 at the second position may be adjacent the base portion 102 such that the lever 200 can be grasped and moved upwardly without interference from the first projection 112. At the second position, the second projection 114 may permit movement of the lever 200 in the downward direction. The second end 122 of the second projection 114 at the second position can be adjacent the base portion 102 such that the lever 200 can move downward without contacting the second projection 114. In an embodiment, the second position may be adjacent the first end 40 or the second end 42 of the base portion 102. It should be appreciated by those having ordinary skill in the art that the projections 112, 114 may move to any position between the first position and the second position.

A first button 130 can restrict or permit movement of the first projection 112. A second button 132 can restrict or permit movement of the second projection 114. The first button 130 can be positioned on the hinge 124 of the first projection 112, such as a top of the first projection 112. The second button 132 can be positioned on the hinge 126, such as at a bottom of the second projection 114. The buttons 130, 132 can be biased in an upward or outward position that prevents movement of the projections 112, 114. Biasing the buttons into a locked position may be accomplished with a spring and locking mechanism or other structure that will be appreciated by those having ordinary skill in the art.

Pressing, depressing or otherwise engaging the buttons 130, 132 can permit movement of the respective projections 112, 114. For example, pressing the first button 130 can permit the first projection 112 to be moved from the first position toward the second position, or vice versa. The first button 130 can be pressed in a direction perpendicular to the direction of movement of the projections 112, 114 and/or toward the second button 132 to move the first projection 112. Likewise, pressing the second button 132 can permit the second projection 114 to be moved from the second position to the first position or vice versa. The second button 132 can be pressed in a direction perpendicular to the direction of movement of the projections 112, 114 and/or toward the first button 130 to move the first projection 112. The first button and the second button are pressed in a direction perpendicular to the radial movement of the first projection 112 and the second projection 114. In an embodiment, the buttons 130, 132 may be biased in a locked position that prevents movement. Pressing the buttons 130, 132 together may permit movement of both of the projections 112, 114.

In an embodiment in which the first button 130 only permits movement of the first projection 112, the first projection 112 may move independently from the second projection 114. Similarly, in an embodiment where the second button 132 only permits movement of the second projection 114, the second projection 114 may move independently from the first projection 112. In another embodiment, the first button 130 can permit movement of the first projection 112 and the second projection 114. For example, pressing the first button 130 can permit movement of the first projection 112 and the second projection 114. Similarly, the second button 132 can be pressed to move the first projection and the second projection 114. In yet another embodiment, movement of the first projection 112 or the second projection 114 can require pressing the first button 130 and the second button 132.

Figure 1B:
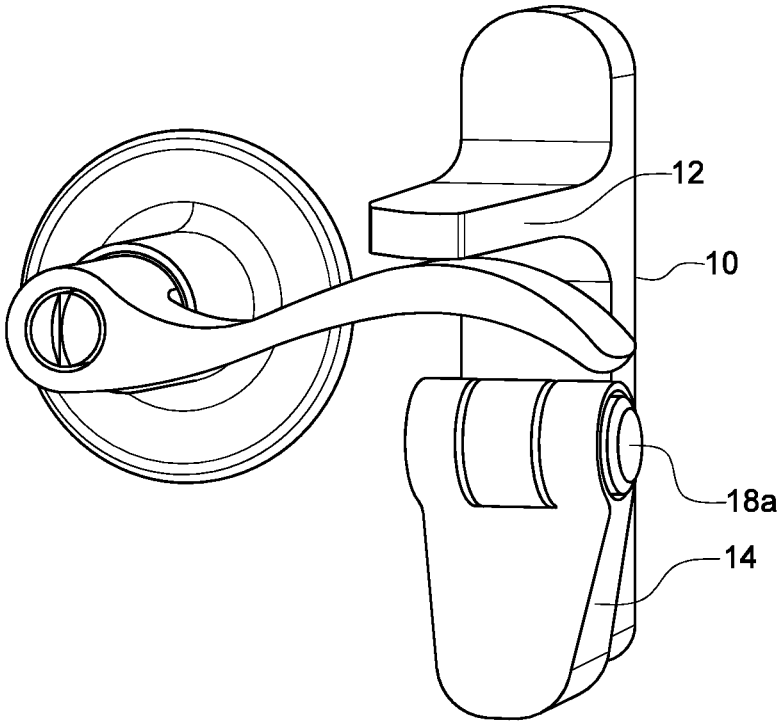
FIG. 1B (PRIOR ART)
FIG. 1B illustrates a prior art door lever device in an open position.

In some uses, the lever 200 may be installed such that the lever 200 only moves in one direction, such as downward or upward. In those uses, the user may choose to have only the first projection 112 or the second projection 114 at the first position, and the other projection 112, 114 may be positioned at the second position to prevent hinderance of use of the lever 200. Accordingly, the independent movement of the projections 112, 114 may be beneficial in various applications of the lever 200. In other uses, the lever 200 may be required to move upward or downward prior to locking or unlocking the lever 200. For example, if the lever 200 requires movement upward to lock the lever 200, then the first projection 112 may be in the second position to permit locking or unlocking. If the first projection 112 is required to be moved upward to unlock the lever 200, then the first projection 112 can be in the first position to prevent movement upward to unlock the lever 200 without first moving the first projection 112 to the second position. Permitting independent movement of the first projection 112 and second projection 114 permits many different uses of the device 100 that are not possible with the prior art device set forth in FIGS. 1A and 1B.

In an embodiment, the device 100 may be secured to the surface 100 of a door. The device 100 may be used to prevent children from accessing a room, such as a parent's room or room with dangerous or other objects not suitable or undesirable for children. The device 100 may be removable secured to the surface 100 and removed from the surface 100 without damaging (or with minimal damage to) the door.

Alternatively, the device 100 may be permanently secured to the door. In an embodiment, the base portion 102 may have a removable backing layer that exposes an adhesive to secure the base portion 102 to the door. The base portion may be positioned on the door behind the lever 200 such that the first projection 112 and the second projection 114 are substantially equal distance to the lever 200. The first button 130 can be pressed to move the first projection 112 to the first position that can be substantially perpendicular to the lever 200 and the width of the base portion 102. At the first position, the lever 200 can be prevented from moving upward to open the door. The second button 132 can be pressed to move the second projection 114 to the first position that can be substantially perpendicular to the lever and the width of the base portion 102. The lever 200 can be prevented from moving downward by the second projection 114 at the first position. At the first position, the projections 112, 114 can prevent the lever 200 from moving upward and downward, and thus, preventing the door from being opened by, for example, a child.

In the event an adult or other individuals desire to open the door, the buttons 130, 132 can be pressed to move the projections 112, 114 from the first position to the second position that is substantially parallel to the base portion 102. Advantageously, the disclosure provides that either of the projections 112, 114 can be moved independently. For example, children may most often pull on the lever 200 in a downward direction. Therefore, in certain embodiments, the adult or other individual may press the button 130 to move the first projection 112 to the second position while maintaining the second projection 114 in the first position. As a result, the lever 200 may be moved upward to open the door, and upon closing the door, the second projection 114 can still prevent downward movement of the lever 200 to open the door. After access to the room is complete, the user may press the first button 130 (and/or the second button 132) to move the projections 112, 114 to the first position. In the event the device 100 is not required to prevent movement of the lever 200, the projections 112, 114 can both be moved to the second position to permit normal operation of the lever 200 without interference. Advantageously, with both the projections 112, 114 at the second position, the lever 200 can be accessed, grasped and otherwise normally operated without having to remove the device 100 from the surface 110 of the door.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims. Furthermore, although the disclosed embodiments are described in detail in the present disclosure, it should be understood that various changes, substitutions and alterations can be made to the embodiments without departing from their spirit and scope.

What is claimed is:

1. A device securable to a door to prevent movement of a lever of a handle, the device comprising:

a base portion having a first side and a second side opposite the first side, the second side securable to a surface of the door, the base portion having a thickness defined between the first side and the second side, the base portion having a width defined between a first end of the base and a second end of the base, the width generally perpendicular to the thickness;

a first projection extending from the base portion, the first projection pivotable about an axis generally perpendicular to the width, the first projection pivotable from a locking position, in which the first projection is configured to extend perpendicular to the lever and prevent movement of the lever, to an unlocked position in which the first projection extends along the second side of the base portion to permit movement of the lever; and a second projection extending from the base portion and positioned a distance from the first projection, wherein the second projection is pivotable about an axis generally perpendicular to the width, the second projection pivotable from a locking position, in which the second projection is configured to extend perpendicular to the lever and prevent movement of the lever, to an unlocked position in which the second projection extends along the second side of the base portion to permit movement of the lever.

2. The device of claim 1 further comprising:

a first button controlling movement of the first projection, the first button biased in a position preventing movement of the first projection, and wherein the button is pressed to permit pivotable movement of the first projection.

3. The device of claim 2 further comprising:

a second button controlling movement of the second projection, the second button biased in a position to prevent movement of the second projection, and wherein the button is pressed to permit pivotable movement of the second projection.

4. The device of claim 3 wherein the first projection moves independently of the second projection.

5. The device of claim 1 wherein the first projection and the second projection each have a length defined between a first end adjacent the base portion and a second end at an opposite the base portion.

6. The device of claim 5 wherein the first projection pivotable from a first position in which the length of the first projection is substantially perpendicular to the width of the base portion to a second position in which the length of the first projection is substantially parallel to the width of the base portion.

7. The device of claim 6 wherein the second projection pivotable from a first position in which the length of the second projection is substantially perpendicular to the width of the base portion to a second position in which the length of the second projection is substantially parallel to the width of the base portion.

8. A method for preventing movement of a lever of a door handle, the method comprising:

securing a back portion of a device to a surface of a door such that a first projection of the device is above a lever of a door handle and a second projection of the device is positioned below the door lever, the back portion of the device having a thickness defined between a first side of the back portion, that faces and is secured to the surface, and a second side of the back portion facing away from the door, the back portion having a width defined between a first end of the back portion and a second end of the back portion, the width generally perpendicular to the thickness; and providing each of a first projection and a second projection pivotally secured to the back portion, where each of the first and second projections are pivotal about an axis at least substantially perpendicular to the width;

moving one of the first projection and the second projection pivotally about the axis at least substantially perpendicular to the width to a first position such that the first projection or the second projection extend substantially perpendicular to the width of the back portion such that the lever of the door handle is prevented from moving upward or downward.

9. The method of claim 8 further comprising:

pressing a first button to move the first projection to the first position, wherein the door lever is prevented from moving upward by the first projection at the first position.

10. The method of claim 9 wherein the first projection at the first position extends outward a distance greater from the back portion than a distance from the back portion to the door lever.

11. The method of claim 10 further comprising:

pressing a second button to move the second projection to the first position, and wherein the door lever is prevented from moving downward by the second projection at the first position.

12. The method of claim 11 wherein the second projection is moveable independently from the first projection.

13. The method of claim 9 further comprising:

pressing the first button to move the first projection from the first position to a second position in which the first projection at the second position extends substantially parallel to the width of the back portion, wherein at the second position the lever is movable upward without contacting the first projection.

14. The method of claim 13 further comprising:

pressing the second button to move the second projection from the first position to the second position in which the second projection at the second position extends substantially parallel to the width of the back portion, wherein at the second position the lever is movable downward without contacting the second projection.

15. The method of claim 14 wherein the first projection and the second projection at the second position permit movement of the door lever upward and downward without contacting the first projection or the second projection.

16. The method of claim 14 wherein the first button and the second button are pressed in a direction perpendicular to the pivotable movement of the first projection and the second projection.

17. A method for preventing movement of a lever of a door handle, the method comprising:

providing a device having a base, a first projection and a second projection, both the first and the second projection pivotally secured to the base, the first projection provided with a first button and the second projection provided with a second button;

securing the device to a surface of a door behind the lever of the door handle, such that the first projection and the second projection of the device are positioned above and below the door lever;

pressing the first button on the first projection to allow the first projection to pivot move the first projection to a first position extending perpendicular with respect to the lever to prevent movement of the lever in an upward direction; and pressing the second button on the second projection to allow the second projection to pivot to a first position extending perpendicular with respect to the lever to prevent movement of the lever in a downward direction.

18. The method of claim 17 further comprising:

pressing the first button to pivot the first projection to a second position at which the first projection is adjacent to the surface such that the lever is moveable upward without contact with the first projection; and pressing the second button to pivot the second projection to a second position at which the second projection is adjacent to the surface such that the lever is moveable downward without contact with the second projection.

19. The method of claim 17 wherein the first projection and the second projection at the first position extend outwardly from the surface of the door a distance greater than a distance that the lever is from the surface of the door.

20. The method of claim 18 wherein the first projection and the second projection are independently movable to the second position.

* * * * *